United States Patent [19]

McInerny

[11] 4,004,506

[45] Jan. 25, 1977

[54] ENDORSER DRUM HAVING INDEXABLE SELF-ALIGNING PRINT WHEELS

[75] Inventor: George P. McInerny, Andalusia, Pa.

[73] Assignee: Brandt-Pra, Inc., Cornwells Heights, Pa.

[22] Filed: Feb. 3, 1975

[21] Appl. No.: 546,621

[52] U.S. Cl. ..... 101/110; 101/86; 101/106; 101/376; 101/380; 64/30 D

[51] Int. Cl.[2] ..... B41J 1/60

[58] Field of Search ..... 101/109–111, 101/85–87, 103, 106, 376–380; 64/30 D; 197/30 E, 17.18; 74/461

[56] References Cited

UNITED STATES PATENTS

| | | | |
|---|---|---|---|
| 2,164,485 | 7/1939 | Yantis | 64/30 D |
| 3,378,127 | 4/1968 | Clary et al. | 101/110 |
| 3,427,961 | 2/1969 | Eggeringhaus | 101/110 |
| 3,453,952 | 7/1969 | Huber | 101/110 |
| 3,467,010 | 9/1969 | King | 101/377 |
| 3,618,310 | 11/1971 | Balchunas | 64/30 D |
| 3,640,369 | 2/1972 | Rolph | 101/109 |
| 3,736,870 | 6/1973 | Johnson et al. | 101/376 |
| 3,741,114 | 6/1973 | Maul et al. | 101/110 |
| 3,796,152 | 3/1974 | Finke et al. | 101/111 |
| 3,872,787 | 3/1975 | Danov et al. | 101/381 |

*Primary Examiner*—Edgar S. Burr
*Assistant Examiner*—William Pieprz

[57] ABSTRACT

An endorser drum for printing variable data on paper sheets for use in document handling and counting devices. The drum is provided with a plurality of splined pins positioned at spaced intervals adjacent the periphery of the drum. Each splined pin is provided with a gear-like periphery comprised of a plurality of tapered projections extending radially outward from the periphery of the splined pin. An annular-shaped resilient print wheel, having an interior surface whose configuration is substantially complementary to that of each splined pin, is fitted upon the splined pin. The exterior surface of the print wheel is provided with a plurality of raised characters each aligned with an associated one of the grooves provided along the interior surface of the print wheel. Each splined pin is secured to the print drum so as to experience no rotational movement. Each print wheel may be incrementally indexed, i.e., revolved, about its associated splined pin, The resiliency of the print wheel permits the grooves of the interior surface to rise over the corresponding tapered projections of the splined pin upon which it is mounted after which the grooves and projections of the print wheel respectively "snap" into engagement with the next adjacent tapered projections and grooves of the splined pin to positively and precisely align the next adjacent raised character into the print position.

22 Claims, 24 Drawing Figures

DOCUMENT
1B400-74-01-1B400-74-01
1B400-74
52
52a
52b
52c
52d
52e
52f
52'
52'
52e'
52f'
52"
6c
6c
60
61
62
150
151
152
153
154
155
156
157
B
C
L
M
74

ENDORSER DRUM HAVING INDEXABLE SELF-ALIGNING PRINT WHEELS

BACKGROUND OF THE INVENTION

The present invention relates to printing devices and more particularly to a novel rotatable print drum for printing variable data on paper documents at relatively high speeds as the documents pass through the printing location and wherein the print drum is provided with resilient self-aligning print wheels.

A large variety of paper document handling and counting devices are presently available in the market place and preferably have a capability of counting and stacking paper documents such as tickets, food coupons, bank notes, checks, and the like. The most desirable paper handling and counting devices preferably have the capability of accurately counting documents at high operating speeds.

In addition to the requirements of counting and stacking documents at high speed, many applications require a printing, cancelling or endorsing capability in which fixed data is imprinted upon each paper document as it undergoes a handling and counting operation, the printing being performed by means of a rotating print drum having raised characters arranged at predetermined locations about the periphery of the drum and adapted to rollingly engage an ink transfer roll and to engage the paper documents moving through the printing location. Many such applications further require that variable data be printed on one surface of each paper document. The printing operation must also be capable of being performed without in any way affecting (i.e., reducing) the high speed operation of the paper handling and counting machine.

In many such printing applications it is desirable and in some cases it is required that the print drum assembly have the capability of imprinting both fixed and variable data upon each paper document. This is important in applications wherein it is desired to indicate the data (day, month and year) on each document. This capability is quite important, for example, in banking operations wherein it is required that a cancellation stamp applied to each check include the data of cancellation. In such applications it is highly desirable to provide a print drum having a plurality of print wheels, each of which is capable of being simply and rapidly indexed to update the date stamp, typically on a daily basis.

Print drums presently available in the market place typically utilize print wheels mounted at spaced intervals about a print drum with each print wheel having a detent assembly for precisely and accurately indexing each portion of print matter on the print wheel into the print position. One exemplary type of detent assembly employs a detent gear and a cooperating detent spring. Such devices, due to the number of components required to provide such an indexing capability, are large and cumbersome and often require servicing time of the order of 1 hour or more for the purpose of changing worn out, broken or outdated print wheels, the large amount of servicing time being required to perform the steps of: disassembling the print drum; removing and replacing the worn out, broken or outdated print wheel; and reassembly of the print drum. In reassembling the unit extreme care must be exercised to assure that the raised characters are replaced in the proper printing positions. This painstaking process, in addition to being time consuming, significantly increases the down-time in the paper handling and counting device.

BRIEF DESCRIPTION OF THE INVENTION

The present invention is characterized by providing a novel, highly compact print drum asembly which eliminates all of the disadvantages of present day print drum assemblies as were described hereinabove. The print drum assembly of the present invention utilizes resilient, annular-shaped self-aligning print wheels which cooperate with stationary mounted splined members arranged at spaced intervals around the periphery of the print drum wherein the novel engaging surfaces of the splined member and resilient print wheel provide for precise aligning of the resilient print wheel while eliminating the need for conventional detent mechanisms typically utilized in prior art devices of the type described hereinabove.

The print drum assembly is comprised of a hollow cylindrical shaped bearing for free-wheelingly mounting the drum assembly upon a stationary shaft. A first cylindrical shaped drum body has a central opening for receiving the bearing member. A plurality of circular shaped recesses provided in one end of a first drum member, have their longitudinal axes parallel to the longitudinal axis of the bearing member and are arranged at spaced intervals around the central axis of the first drum body. Splined pin members are fixedly mounted into each opening so as to experience no rotational movement about their axes. Each splined member is provided with a plurality of tapered projections arranged at spaced intervals around the exterior surface of the splined member and collectively define a star-like surface configuration. The outer edge of each tapered projection is truncated to provide a flat surface at the extremity of each tapered projection.

A resilient annular-shaped print wheel is slipped upon each splined member and is provided with an interior contour complementary to that of the splined member. The exterior surface of each print wheel is provided with integrally formed raised alphabetic and/or numeric characters, symbols, punctuation marks, bar codes and/or other indicia, which are arranged at spaced intervals about the wheel and which are adapted to extend outwardly and beyond the exterior surface of the first cylindrical drum body when in the printing position. For purposes of simplicity, any reference to the indicia provided upon the print wheel and/or index strip described herein, should be understood to include any of the possible categories of indicia referred to hereinabove and/or other related types of indicia.

The drum assembly is further comprised of a second drum body, mounted upon the bearing and secured to the first drum body by suitable fastening means wherein the first and second drum bodies are adapted to sandwich the self-aligning resilient print wheels therebetween.

The complementary engaging surface patterns of the splined member and its associated wheel cooperate to precisely position one of the raised characters (arranged at spaced intervals about the print wheel) in the printing position. Each resilient print wheel is incrementally indexed about its associated splined pin upon the application of a force upon the exterior surface of the print wheel in order to revolve the print wheel about its associated splined pin wherein the cooperating projections arranged at spaced intervals about the exterior surface of the print wheels are caused to slide over the projections provided on the associated splined pins, whereupon the print wheel projections undergo compression and slight deformation as they move towards the next adjacent groove in the splined pin, at which time the print wheel projections snap into position upon the next adjacent splined pin grooves to thereby move and accurately position the next adjacent raised character precisely into the printing position. Once each resilient print wheel is properly indexed it will remain aligned in the desired position and will not accidentally be advanced when the print drum assembly is rotating during the performance of a high speed printing operation.

The first print drum body is preferably provided with an annular slot and releasable securement means for receiving and affixing an elongated resilient insert strip fitted into the annular groove in the first drum body and which has its free ends positioned beneath the securement member. The elongated insert strip is provided with raised lettering about its exterior surface to imprint fixed data upon the paper document. The elongated strip is preferably provided with one or more index marks which cooperate with information imprinted by the self-aligning print wheels to positively identify the starting point of the printed variable data. Additional grooves and securement means may be provided in either the first or second drum bodies to accommodate additional insert strips, if desired.

Many present day paper handling and counting devices have a capability of handling and counting paper documents whose dimensions, measured in the feed direction, lie in the range from 2 to 8 or 9 inches. In such cases, the dimensions of the print drum are chosen to assure that the characters arranged around the circumference will imprint all of the desired data upon each paper document at least once. By selecting the print drum diameter in the above manner, a single print drum which may be used for printing upon documents of varying dimensions is thereby obtained, providing a single print drum assembly which need not be changed even though the paper handling device is running various batches of documents of varying dimensions, and which is quite small and compact so as to print a full and complete message or plurality of messages on documents whose length in the feed direction is quite small.

BRIEF DESCRIPTION AND OBJECTS OF THE INVENTION

It is therefore one object of the present invention to provide a novel self-aligning print wheel assembly having only one moving part and which embodies a design that eliminates the need for and components of detent mechanisms required in conventional designs which are adapted to be indexed.

Another object of the present invention is to provide a novel self-aligning print wheel assembly comprising a resilient annular-shaped member having a plurality of print surfaces, said member being mounted upon a splined pin, wherein engaging surfaces of the print wheel and the splined pin have complementary configurations adapted to easily index the print member and yet accurately align the desired raised character or characters to the print position and being further adapted to prevent accidental movement of the resilient print wheels during the printing operation.

Still another object of the present invention is to provide a novel rotatable print drum assembly for imprinting variable data on paper documents and the like wherein the drum assembly is provided with indexable self-aligning print wheels and further having at least one resilient print band for imprinting fixed data in the form of raised characters and further having at least one raised index mark which is imprinted upon each paper document at least once and which serves to identify the starting point of the variable data imprinted upon the paper document.

Still another object of the present invention is to provide a novel print drum assembly for imprinting variable data upon paper documents as they pass the drum assembly at high speed, which drum assembly is further provided with a plurality of indexable self-aligning print wheels mounted on stationary splined pins and indexable about each pin to precisely position the desired character and/or characters in the print position, the cooperating engaging and complementary contours of the pin and print wheels being adapted to prevent the print wheels from being indexed accidentally during a printing operation.

The above as well as other objects of the present invention will become apparent when reading the accompanying description and drawings in which:

FIG. 1*a* is a perspective view of a resilient print wheel designed in accordance with the principles of the present invention.

FIG. 1*b* is a view of the print wheel of FIG. 1*a* looking in the direction of arrows 1*b*—1*b*.

FIG. 1*c* is an enlarged detailed view showing a portion of the wheel of FIG. 1*a*.

FIGS. 2*a* and 2*b* are side and end views, respectively, of a splined pin adapted for indexably mounting a print wheel of the type shown in FIGS. 1*a*–1*c*.

FIGS. 3*a*, 3*b*, and 3*c* are end views showing portions of a splined pin and a print wheel mounted thereon and which are useful in describing the manner of indexing a print wheel.

FIG. 4*a* is an end view of a print drum assembly that utilizes the self-indexing print wheels of the type shown in FIGS. 1 and 2.

FIG. 4*b* shows a side view of the print drum of FIG. 4*a* and which is partially sectioned to show the adjustment assembly of FIG. 4*a* looking in the direction of arrows 4*b*—4*b*.

FIG. 4*c* is a sectional view of the print drum of FIG. 4*a* looking in the direction of arrows 4*c*—4*c*.

FIG. 4*d* is a sectional view of the print drum of FIG. 4*b* looking in the direction of arrows 4*d*—4*d*.

FIG. 5*a* shows an end view of the removable drum body of the drum assembly of FIGS. 4*a*–4*d*, and FIG. 5*b* shows a sectional view of the drum body of FIG. 5*a* looking in the direction of arrows 5*b*—5*b*.

FIGS. 6*a* and 6*b* are top plan views of the resilient endorser inserts which may by utilized with the endorser drum asembly of FIGS. 4*a*–4*d*.

FIGS. 6*c* and 6*f* show elevational views of a portion of the resilient insert wherein FIG. 6*c* shows the insert of FIG. 6*a* looking in the direction of arrows 6*c*—6*c*, and FIG. 6*f* shows another embodiment thereof.

FIGS. 6*d* and 6*e* show plan views and documents and the manner of imprinting to facilitate an understanding of the present invention.

FIG. 7 is an elevational view showing a portion of a document counter in which assembly of the type shown in FIGS. 4*a*–4*d* may be utilized to great advantage.

FIGS. 7*a* and 7*b* show end and top plan views, respectively, of the endorser drum and drive belt arrangement of FIG. 7.

FIG. 8 is an end view showing another preferred embodiment of the present invention.

DETAILED DESCRIPTION OF THE INVENTION

Figures 1A, 1B, 1C, 2A, 2B, 3A, 3B, 3C:
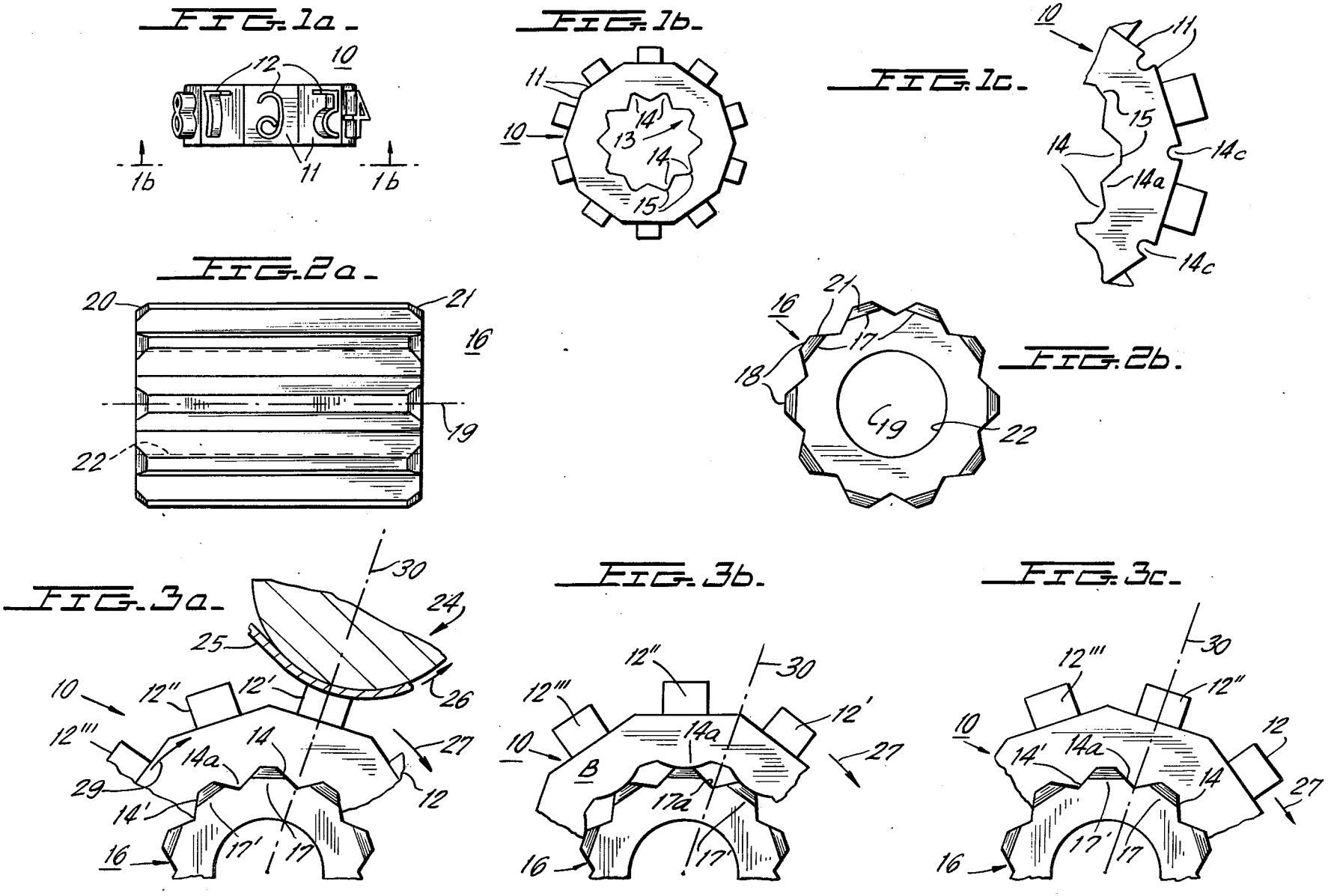

FIGS. 1*a*–1*c* show print wheel 10 designed in accordance with the principles of the present invention and having a closed-loop annular configuration preferably formed from a resilient material such as, for example, rubber. The elasticity of the material enables the print member to be deformed and/or stretched during use whereby the resilient characteristics assures that wheel 10 will rapidly resume its "rest" condition when the forces causing deformation and/or elongation are removed. The exterior surface of the drum 10 is provided with a plurality of substantially flat faces 11 each having an integrally formed raised character or symbol 12 (or other "indicia" referred to hereinabove) extending upwardly from each flat face 11. Each character 12 may be two or more characters collectively occupying the area of each character 12, if desired.

The interior surface 13 is provided with a substantially star-like configuration collectively formed by a plurality of V-shaped grooves 14, each of which are truncated at their base portions to form flat base portions 15 which are best shown in FIG. 1*c*, and which cooperate to form interspersed projections 14*a*.

In the preferred embodiment of FIG. 1*a*, there is shown some of the raised characters, numerals or symbols, or other indicia, wherein the numerals "4", "5", "6", "7" and "8" can be seen arranged at spaced intervals on their associated flat surfaces 11. It should be understood however that raised characters may be alphabetic characters, symbols or other indicia and, if desired, each one of the faces 11 may be provided with more than one character or symbol (preferably smaller in size than the numeral 12). A "set" of indicia may consist of the numbers "0" through "9"; alphabetic characters "A" through "Z"; punctuation symbols; bar codes; binary codes of N-bit length; etc., or a combination thereof. Typical sets may contain total indicia as few as five or as many as 64 in number.

Each resilient print wheel 10 is mounted upon a splined pin 16, shown best in FIGS. 2*a* and 2*b*, and having a generally annular-shaped exterior surface comprised of a plurality of substantially V-shaped projections 17 extending radially outwardly from the longitudinal axis 19 and each being truncated at their free ends to provide a flat outer surface 18. The left and right-hand ends of the splined pin are machined to provide each of the projections 17 with beveled left and right-hand ends 20 and 21 to facilitate the mounting of a resilient print wheel, in a manner to be more fully described. Selected ones of the pins 16 are provided with openings 22 extending completely through each pin for a purpose to be more fully described.

FIG. 3*a* shows the manner in which the print wheel 10 is mounted on a pin 16. As can clearly be seen from FIG. 3*a*, the interior surface contour of the print wheel, comprised of the truncated V-shaped grooves 14 and interspersed projections 14*a*, is adapted to substantially conform to the exterior surface contour of the splined pin 16 comprised of the respective truncated V-shaped projections 17 and interspersed grooves 17*a*. Ideally, the print wheel is adapted to fit pin 16 without experiencing any stretching or without experiencing any "play". As a practical matter a tolerance of a few thousandths of an inch in either direction from a perfect fit is quite acceptable wherein the amount of play or "stretching" is minimal.

The V-shaped projection 14*a* between each pair of adjacent truncated V-shaped grooves 14, has its apex in alignment with the center of each raised character to provide the largest amount of material directly beneath the character. However, the base of a truncated V-shaped groove 14 may be aligned with the center of a character or one sloping wall of a groove 14 may be aligned with the center of a character if desired. Also, the configurations of both wheel 10 and pin 16 may be curved or rounded at each apex and/or may have curved sloping walls to provide an undulating or sinusoidal shaped pattern, if desired.

The novel indexable self-aligning feature of the variable print wheel assembly can best be understood from a consideration of FIGS. 3*a*–3*c*. The splined pin, as will be described in greater detail hereinbelow, is mounted in a stationary fashion within the drum assembly of FIGS. 4*a*–4*d* in order to experience no rotational movement about its longitudinal axis 19 (see FIG. 2*a*). Numeral 24 designates a drive belt (only a portion of which is shown in FIG. 3*a*) which serves as a backing or support for a paper document 25 moving in an arcuate path and in the direction shown by arrow 26 so as to pass between drive belt 24 and the drum assembly on which the splined pin and the self-aligning print wheel are mounted.

The splined pin and self-aligning print wheel do not rotate relative to one another, but revolve about the central axis of the print drum assembly 40 (whose axis of rotation is shown at point "X" in FIG. 4*a*) in the direction shown by arrow 27. Phantom line 30 represents the center line of the print position. It should be noted that the elements shown in FIG. 3*a* have been grossly exaggerated (enlarged in size and altered as to relative location) to facilitate and understanding of the invention. For example, it should be understood that the raised character 12' shown in the print position would, in actuality, undergo at least slight compression as it engages the confronting surface of paper document 25. It should also be understood that paper document 25 would make somewhat firm engagement with both raised character 12' and the confronting surface of drive belt 24 when passing through the print position.

Let it now be assumed that it is desired to index character 12'', shown in FIG. 3*a*, to the punt position presently occupied by the raised character 12', of FIG. 3*a*. In order to accomplish this, the operator may use an instrument such as a small pick or a screwdriver, or may use his finger and apply the tip of the instrument or the tip of his finger (i.e. finger nail) to the exterior surface of the print wheel 10, for example, by pressing against the left-hand surface of raised character 12'', as indicated by arrow 28, so as to move print wheel 10 about stationary splined pin 16 in the direction shown by arrow 29 thereby moving the raised letter 12'' towards phantom line 30. The exterior surface portion of print wheel 10, against which the instrument tip or fingertip is placed, is sufficiently resistant to yielding to the force applied to the print wheel by the instrument to cause the print wheel to be moved from the position shown in FIG. 3*a* to the position shown in FIG. 3*b*. The apex of V-shaped projection 14*a* in the print wheel, and located between the truncated V-shaped grooves 14 and 14', is caused to slide along one sloping side wall 17*a* of pin projection 17 and then upon truncated V-shaped projection 17 of splined pin 16. The annular body B of the print wheel experiences some elongation or stretching and at the same time the V-shaped projection 14*a*, which extends radially inwardly and which is positioned between the truncated V-shaped grooves 14 and 14' on the print wheel, is caused to move towards and upon the flat surface 18' of truncated V-shaped projection 17' of splined pin 16 causing the projection 14*a* to become compressed and deformed in the manner shown in FIG. 3*b*. At this time it can be seen that the print wheel has been revolved through an angle of approximately 18° about the longitudinal axis 19 of pin 16 (see FIG. 2) in moving the next character 12'' towards the printing position, whose center line is designated by phantom line 30. The force imparted to wheel 10 moves print wheel 10 still further in the direction shown by arrow 29 to cause the V-shaped projection 14*a* of wheel 10 to move off flat surface 18' of truncated V-shaped projection 17' of splined pin 16 and into the V-shaped groove defined by sloping walls 17*a*' and 17*a*'' of splined pin 16 and which is located between truncated V-shaped projections 17 and 17'. The resiliency of the material from which the wheel is formed causes the projection 14*a* to spring back to its normal rest condition whereby the projection 14*a* snaps into the V-shaped groove defined by side walls 17*a*' and 17*a*'', as shown best in FIG. 3*c*. Whereas the above description makes reference to only one of the V-shaped projections 14*a* in print wheel 10 as experiencing deformation as it rides over the truncated V-shaped projection 17 in splined pin 16, it should be understood that all of the projections undergo at least slight compression and deformation as they ride over an associated one of the truncated V-shaped projections 17 in splined pin 16. Thus all of the V-shaped projections in print wheel 10, and which are positioned between each of the truncated V-shaped grooves 14 in the print wheel, substantially simultaneously spring back to their normal rest (i.e., uncompressed) condition to bring the entire print wheel back to rest position and thereby index the print wheel so that the next adjacent character 12'' is moved precisely into the printing position whose center line is represented by phantom line 30. Thus the print wheel (having ten characters) moves through one-tenth of a revolution (i.e., 36°) as each raised character is indexed about splined pin 16. It should be understood that the resilient wheel may be indexed in either the clockwise or the counterclockwise direction to accurately align the next raised character into the print position. The operator can physically feel the snapping action of the print wheel as it is incrementally indexed and, in fact, can hear the sound of the print wheel snapping into position on pin 16 to further facilitate the appropriate indexing of the print wheel. It can be seen that this arrangement provides a very simplified method for indexing variable data while at the same time eliminating the complex and space consuming detent assemblies required in prior art configurations which typically require at least a detent gear and a resilient detent spring, in addition to the print wheel and the shaft on which the print wheel was mounted.

As shown in FIG. 1*c*, the exterior surface of the print wheel 10 may be provided with indentations 14*c* at spaced intervals around the interior surface and adapted for receiving the tip of an instrument or the tip of a fingernail, for example, to facilitate indexing of the print wheel 10 about the pin 16. The grooves may be of any desired shape, i.e., elongated, round, square, polygonal, etc., wherein the recess provided receives the tip of a tapered pointed pick or other instrument to index the print wheel.

FIGS. 4*a*–4*d* show a print drum assembly 40 employed to mount a plurality of self-indexing print wheel sub-assemblies of the type shown in FIG. 3*a*. The drum assembly in FIGS. 4*a*–4*d* is comprised of an elongated cylindrical shaped bearing 41 adapted to be free-wheelingly mounted upon a fixed shaft, in a manner to be more fully described in connection with FIGS. 7–7*b*.

Figure 5A:
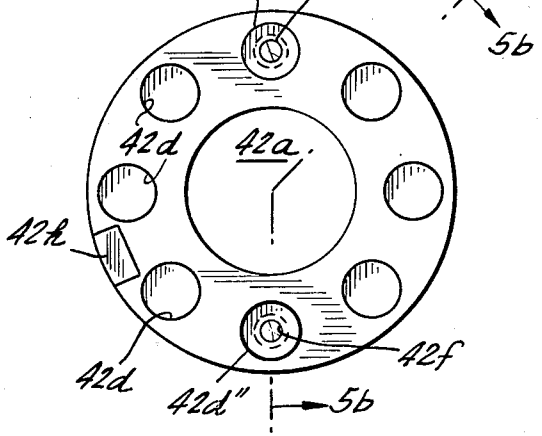

A first drum body 42 (see FIGS. 5*a* and 5*b*) of substantially annular shape is provided with a central opening 42*a* for receiving bearing 41. The left-hand end of first drum body 42 is provided with a substantially semi-circular shaped groove 42*b* extending around the entire periphery of drum body 42 and which is adapted to be frictionally engaged by a closed loop O-ring which engages a closed loop drive belt for imparting rotation to the drum assembly 40, in a manner to be more fully described.

First drum body 42 is further provided with a substantially square shaped recess 42*c* surrounding drum 42 and adapted to receive a resilient insert strip 52, to be more fully described, and which is utilized to print fixed data upon the paper documents. Additional recesses of this type may be provided to accommodate additional insert strips, if desired.

Figure 4A:
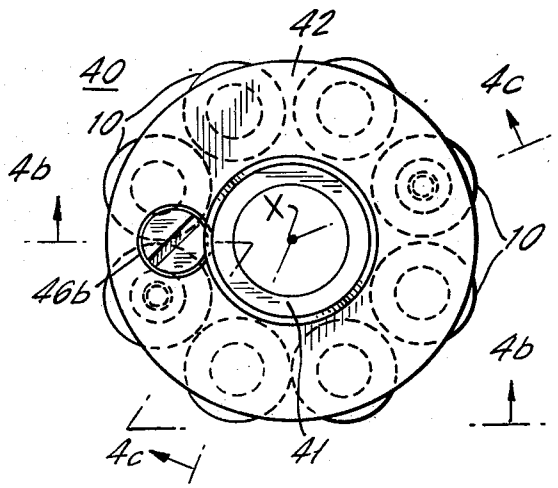
Figure 4B:
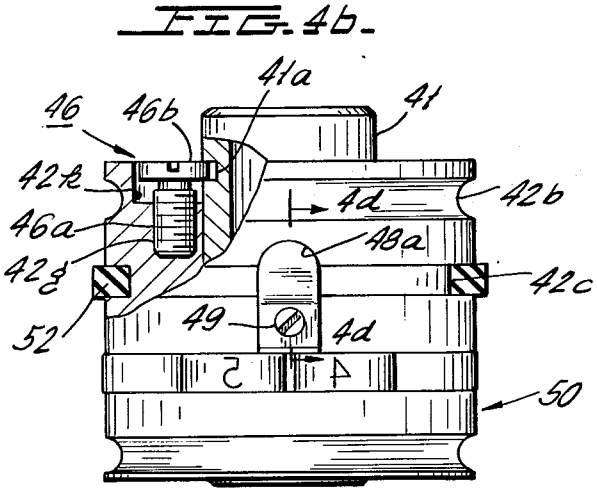
Figure 4C:
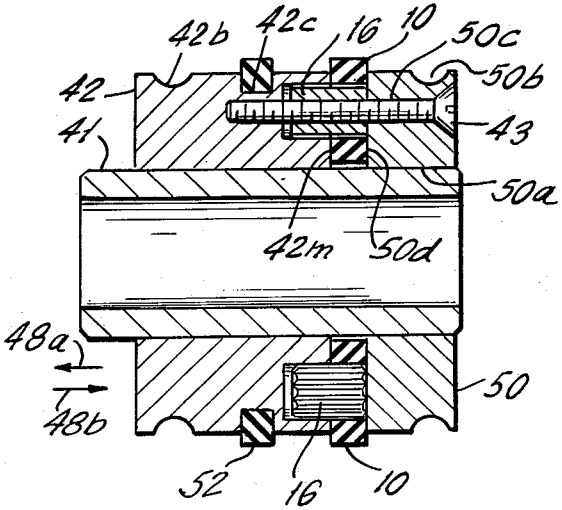
Figure 5B:
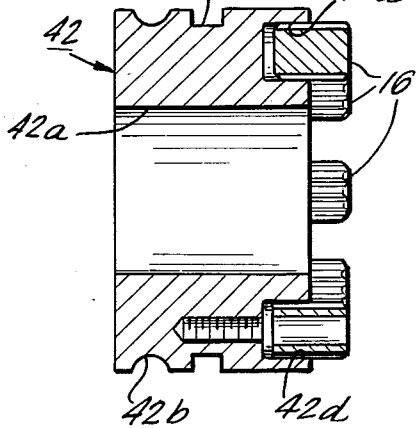

The right-hand end of first drum body 42 is provided with a plurality of cylindrical shaped recesses 42*d* (note especially FIG. 5*a*) each of which is adapted to receive one end of a splined pin 16 in the manner shown in FIG. 5*b*. Two of the recesses 42*d*' and 42*d*'' are provided with tapped apertures 42*e* and 42*f*, respectively, for receiving threaded fasteners such as, for example, the threaded fastener 42 shown in FIG. 4*c*. These threaded fasteners are for the purpose of securing a second drum body 50 to the first drum body 42, in a manner to be described in more detail hereinbelow.

A print wheel is fitted upon each splined pin 16 in the manner shown best in FIG. 4*c*. It can best be seen from FIG. 5*a* that two of the splined pins are provided with central openings 22 (see FIG. 2*b*) to provide a clearance opening for the threaded fasteners 43.

First drum body 42 is provided at its left-hand end with a recess 42*k*. A tapped aperture 42*g* extends downwardly from the base portion of recess 42*k* and is adapted to receive threaded fastener 46 whose threaded portion 46*a* threadedly engages tapped aperture 42*g*. A marginal portion of the head 46*b* of threaded fastener 46 is slidably fitted into a groove 41*a* provided in bearing 41 and, by rotation of threaded fastener 46, the first print body 42 is adapted to be longitudinally moved in either the left- or right-hand direction, shown respectively by arrows 48*a* and 48*b* (FIG. 4*c*), relative to bearing 41 in order to accurately adjust the longitudinal positioning of the print body and hence of the self-aligning print wheels and index strip relative to the closed loop driving belt, to be more fully described hereinbelow in connection with FIGS. 7, 7*a* and 7*b*.

Figure 4D:
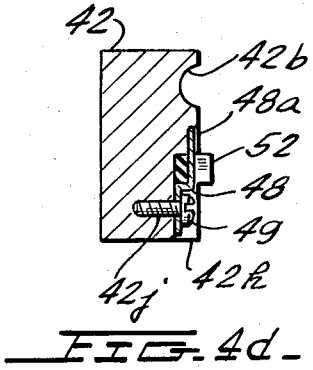

FIG. 4*d* is a sectional view of a portion of drum body 42 which is provided with an elongated axially aligned recess 42*h* for receiving substantially Z-shaped clamping member 48 secured to first drum body 42 by threaded fastener 49 which threadedly engages tapped opening 42*j* in drum body 42. Free end 48*a* of releasable clamping member 48 overlies a portion of the substantially rectangular shaped recess 42*c* in drum body 42 so as to clamp the free ends of a resilient insert strip carrying fixed data and which will be more fully described hereinbelow.

Print drum assembly 40 is further comprised of a second drum body 50 (note especially FIGS. 4*b* and 4*c*) which is an annular shaped member having a central opening 50*a* for receiving bearing 41. The exterior cylindrical surface is provided with a semi-circular shaped continuous groove 50*b* for frictionally engaging an O-ring type belt which imparts a driving force to the drum 40 during the printing operation, in a manner to be more fully described.

Second drum body 50 is further provided with a pair of clearance openings 50*c*, one of which is shown in FIG. 4*c*, for receiving the threaded fasteners 43 which serve to secure second drum body 50 to first drum body 42 and which further serve to prevent the print wheels 10 from experiencing any longitudinal movement since they are sandwiched in between the right-hand end surface 42*m* of first drum body 42 and the left-hand end surface 50*d* of second drum body 50.

As can be seen best from a consideration of FIGS. 4*a* and 4*c*, as the print drums revolve about bearing 41, a portion of each of the peripheries of print wheels 10 extend beyond the outer periphery of the first and second drum bodies 42 and 50 in order to rollingly engage an ink transfer wheel and a paper document in a manner to be more fully described. The integrally formed raised characters have been omitted from FIGS. 4*a* and 4*c* for purposes of simplicity.

Figures 6A, 6B, 6C, 6D, 6E, 6F, 8:
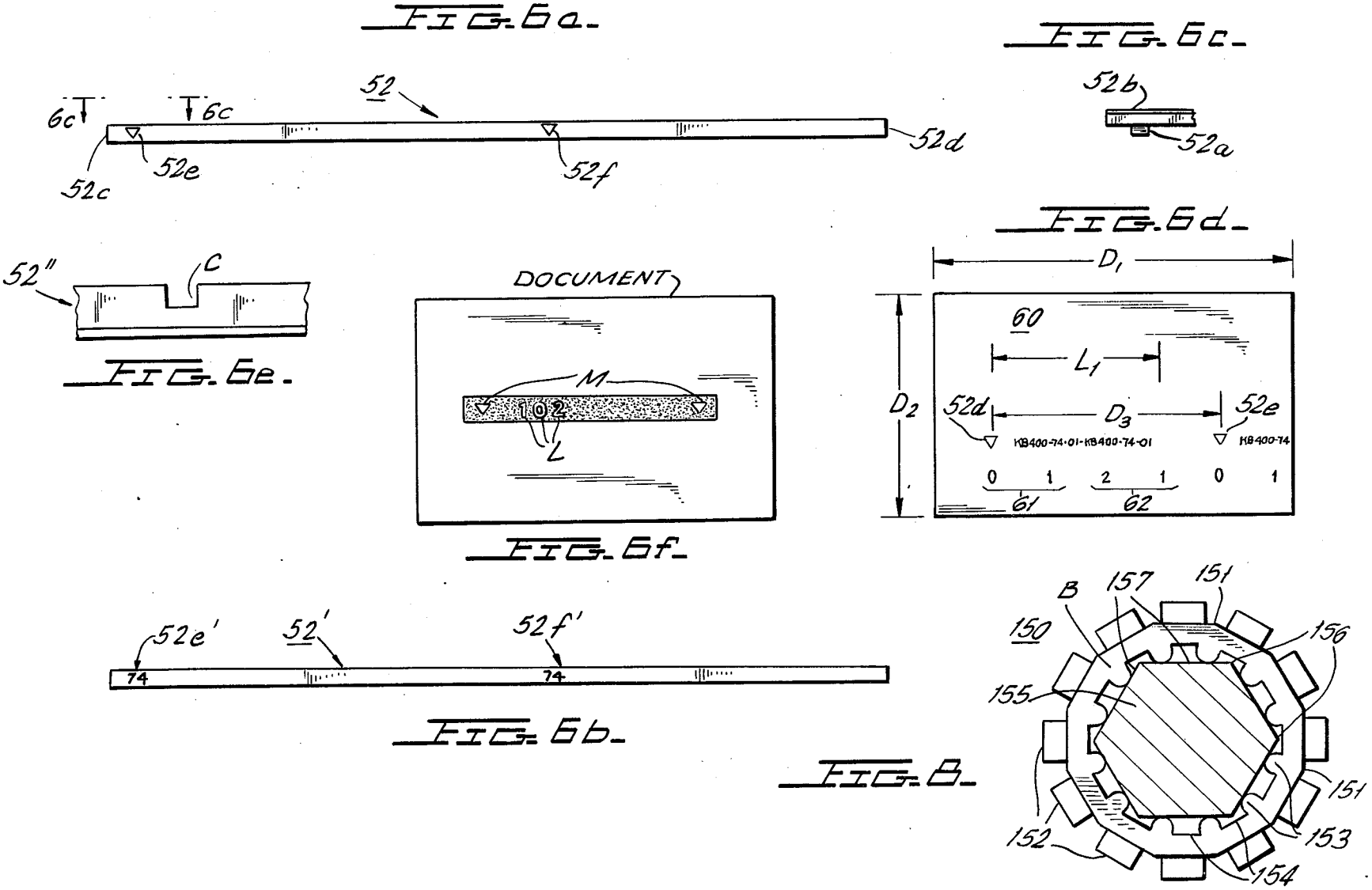

FIGS. 6*a* and 6*b* show top plan views of elongated insert strips which are adapted to be positioned within the square-shaped recess 42*c* of first drum body 42. Insert 52 of FIG. 6*a* is preferably formed of a resilient material such as, for example, rubber or vinyl and has a durometer selected to have a characteristic which enables the raised characters or symbols formed along the surface of the strip to undergo at least slight compression as they ride upon and imprint a paper document. FIG. 6*c* shows one raised indicia 52*a* provided on the surface of strip 52. The back surface of strip 52 is preferably reinforced with a cloth backing 52*b* to limit the amount of elongation or stretching which the strip may undergo. Strip 52 is mounted to first drum body 42 by loosening threaded member 49, positioning one end, for example, end 52*c*, of strip 52 beneath the portion of clamping member 48, pressing the strip into groove 42*c* and then sliding the opposite end 52*d* of strip 52 beneath clamping member 48, after which threaded member 49 is then tightened to firmly clamp the insert strip 52 into position.

The insert strip is preferably provided with at least one raised index marker 52*e*, shown in FIG. 6*a* as having a triangular shape. The index marker 52*e* cooperates with the variable data imprinted on documents by print wheels 10 to positively indicate the starting point of the variable data. If desired, the insert strip 52 may be provided with additional index marks such as, for example, the index mark 52*f*. Two index marks serve to mark both the beginning and end of a message. Additional index marks may be employed to indicate the beginning (and/or end) of each message in applications where more than one message is provided around the drum assembly 40. In the preferred embodiment the fixed and variable data is repeated twice around drum assembly 40 and said data is desired to be printed at least once upon documents greater in length $D_1$ (said length being measured in the feed direction) than a predetermined minimum length. FIG. 6*d* shows a plan view of a paper document whose dimension $D_1$ in the feed direction is of the order of 3 inches and whose dimension $D_2$, measured in the direction perpendicular to the feed direction, is of the order of 2 inches. This document substantially represents the smallest documents to be counted and imprinted upon. Index marks 52*e* and 52*f* imprinted upon the paper document 60 positively indicate both the starting and ending points of the variable data the full message of which is shown to be comprised of four numerals wherein a first group of numerals 61 which read "01" represents the month of the year (for example) and a second group 62 which reads "21" and represents the day of the month. As shown in FIG. 6*b*, the insert strip 52′ may, as an alternative to being provided with a raised index mark of the type shown in FIG. 6*a*, be provided with the raised lettering, i.e., "74", at each index position 52*e*′ and 52*f*′ to serve both as the index mark and as the means for identifying the year of imprinting. The circumference of the print drum assembly is selected so as to be assured of printing at least one full and complete message within a space extending between index marks 52*e* and 52*f* and whose length (measured in the feed direction) is of the order of 2 inches thereby assuring that, for a document whose dimension $D_1$ is of the order of at least 2 inches, at least one full and complete message will be imprinted thereon. In the example given, it can be seen that at least one full message will be printed on a document whose length $D_1$ measured in the feed direction is at least 2 inches long which represents the distance $D_3$ between the index marks 52*d* and 52*e*. Obviously, documents greater in length than 2 inches, for example, the document shown in FIG. 6*d*, have at least one full message imprinted thereon, If desired, documents of even shorter dimensions (in the feed direction) may be imprinted with a "full" message by reducing the diameter of the drum 40.

Figure 7:
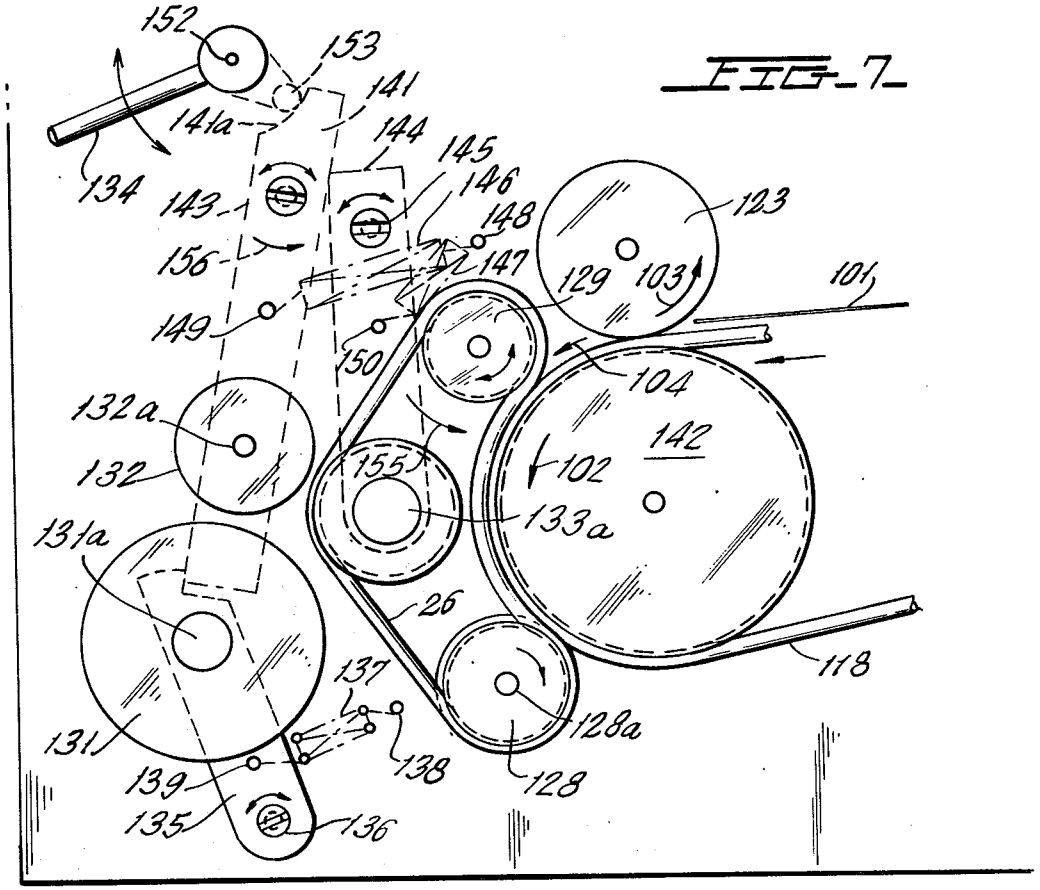
Figure 7B:
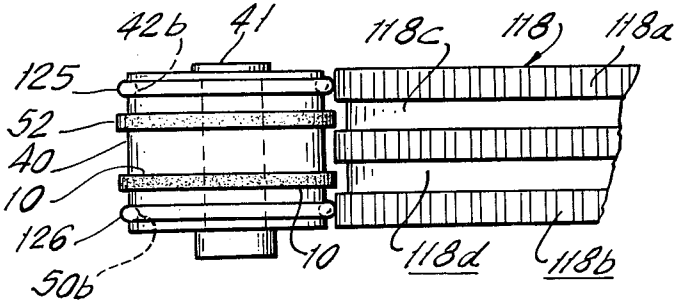
Figure 7A:
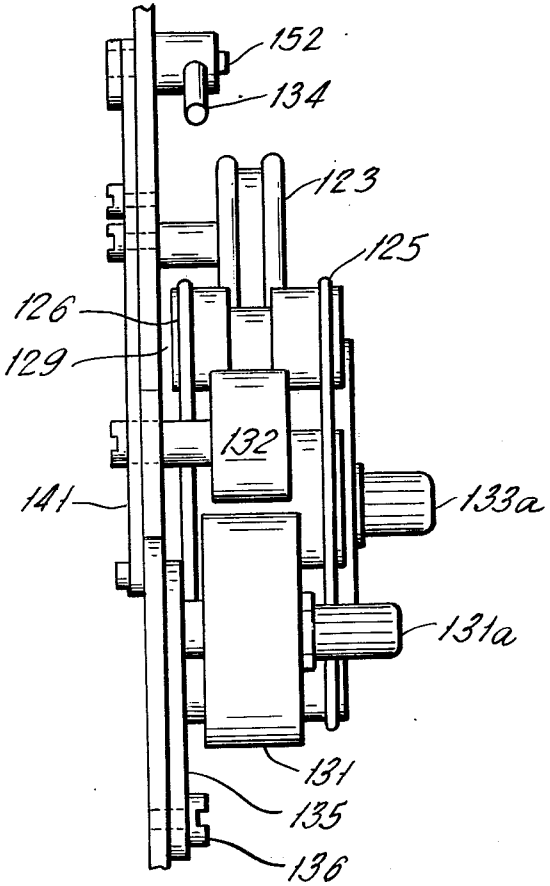

FIGS. 7, 7*a* and 7*b* show a portion of paper handling and counting mechanism described in application Ser. No. 465,700, filed on Apr. 30, 1974 now U.S. Pat. No. 3,994,210 issued Mar. 16, 1976 to the assignee of the present invention. For purposes of understanding the present invention only a portion of the document handling and counting device will be described herein. Documents 101 move between an elongated closed loop drive belt 118 mounted on large roller 142 and moving in the direction shown by arrow 102. A stripper wheel 123 rotates in a counterclockwise direction, as shown by arrow 103, to assure that only single documents will pass between the drive and stripper wheels. Single documents passing between the drive belt 118 and stripper wheel 123, enter into the region shown by arrow 104 whereupon each document enters between belt 118 and O-rings 125 and 126, which are entrained about idler wheels 129 and 128 and further fitted within the semi-circular grooves 42*b* and 50*b* in drum bodies 42 and 50, as shown, for example, in FIG. 4*b*. The O-rings 125 and 126 frictionally engage either the ridges 118*a* and 118*b* of drive belt 118 or frictionally engage a document passing therebetween to impart driving rotation to idler pulleys 128 and 129 and further to impart driving rotation to print drum assembly 40. The print drum bearing 41 is mounted upon shaft 133*a* which is rigidly secured to the swingable end of shaft arm 144. Operation of handle 134 enables the drum 40 to move between the disengaged (i.e., non-print) position, displacing drum 40 from drive belt 118 and the paper documents passing therearound, and from ink transfer roller 132, to an engaged (i.e., print) position wherein the raised lettering provided around the drum assembly 40 and including both the fixed and variable data engages both ink transfer roll 132 and the paper document passing between the drive belt 118 and the O-rings 125 and 126. A detailed description of the manner in which the mechanism comprised of operating handle 134 and swingable arm serves to move the print assembly between the engaged and disengaged position is set forth in detail in the copending application referred to hereinabove and a detailed description has been omitted herein for purposes of simplicity, said description being incorporated herein by reference thereto.

An ink roll 131 transfers ink to transfer roll 132 which, in turn, transfers the ink to the raised letters provided about print drum assembly 40 when the endorsing mechanism is in the engaged position. As can best be seen from a consideration of FIG. 7*b*, drive belt 118 is provided with a pair of grooves 118*c* and 118*d*. The flexible insert 52 and self-indexing print wheels 10 can be seen to enter at least partially into the grooves 118*c* and 118*d* to print upon the paper document. Grooves 118*c* and 118*d* serve to prevent transfer of ink to drive belt 118 in the event that no paper documents are being fed into the paper handling and counting equipment and when the print drum assembly is in the printing or endorsing position as well as preventing transfer of ink to the drive belt 118 as gaps between the trailing edge of a downstream document and the leading edge of the next upstream document pass the endorser drum assembly, thereby preventing any transfer of ink to belt 118 and undesirable back printing of the paper document by transfer of ink from belt 118 to the paper document.

The adjustable threaded member 46, shown best in FIG. 4*b*, serves to assure that the fixed data of insert 52 and variable data of the self-aligning print wheels 10 are in proper alignment with the grooves 118*d* and 118*c*, respectively, of drive belt 118.

It can thus be seen that the foregoing invention applies a novel endorser assembly which, while being quite small and compact (the preferred embodiment has a diameter of the order of 1.375 inches) is nevertheless capable of providing up to eight indexable self-aligning print wheels each capable of accurately and precisely positioning a number, symbol or other character into the print position thereby completely eliminating the need for complex detent assemblies utilized in prior art endorsing assemblies. The self-aligning print wheel has a substantially long, useful operating life, and in the event of being either worn out, broken, or otherwise defective, may be simply and readily replaced by removing the fastening members 43, removing the second drum body 50, removing and replacing the defective or worn out resilient print wheels and replacing them with new wheels, replacing the second drum body 50 and replacing and tightening the threaded fasteners 43.

The insert strip 52 may be simply and readily replaced by: loosening member 49; removing worn out, defective or outdated insert strips; inserting a fresh insert strip; positioning both ends of the strip beneath clamp member 48; and tightening screws 49. The print drum may be simply and readily removed from stationary shaft 133 by loosening a fastener to draw a split-ring fastening member together, as shown in FIGS. 12*a* through 12*f* of the above mentioned copending application, which thereby enables the print drum assembly to be rapidly removed, serviced, and replaced on stationary shaft 133.

FIGS. 1–3 show the self-aligning print wheel as being provided with 10 truncated V-shaped grooves and splined pin 16 as being provided with an equal number of truncated V-shaped projections. However, it should be understood that a lesser or greater number of such grooves and cooperating projections may be provided and a lesser or greater number of characters may be provided, with a total number of V-shaped projections which is less than the total number of grooves provided in the interior surface of resilient print wheel.

FIG. 8, for example, shows an alternative embodiment of the present invention in which the resilient print wheel 150 is provided with 12 flat surfaces 151 each having an integrally formed raised character 152 projecting outwardly therefrom. The interior surface of resilient print wheel 150 is provided with 12 radially aligned inwardly directed projections 153 each of said projections having a rounded free tip. Each projection is positioned mid-way between each adjacent pair of raised characters 152 so as to define a substantially square shaped groove 154 between each adjacent pair of projections 153, and with each groove being substantially in alignment with the centers of the raised characters 152.

The resilient print wheel is mounted upon a fixed hexagonal (six-sided) shaft 155 so that each apex 156 between each pair of adjacent surfaces 157 is positioned within every other groove 154 in resilient print wheel 150.

The self-aligning resilient print drum is indexed in the same manner as resilient print drum 10 described hereinabove in connection with FIGS. 3*a* through 3*c*, wherein, upon the application of a force upon the surface of resilient print wheel 150 so as to revolve it about shaft 155, the body B of the resilient print wheel 150 undergoes some degree of elongation and further the rounded projections 153 undergo some bending, depression and deformation until the next raised character is precisely indexed to the print position at which time the deformed projections 153 snap back to their rest position whereupon the next raised character is precisely indexed. Once the print wheel is properly indexed, the locking effect of the print wheel with the external indexing force removed is sufficient to prevent accidental indexing of the print wheel when performing a printing operation. The groove beneath the "indexed" character lies upon surface 157 of shaft 155 while the grooves to the left and right receive the apices at the edges of the surface. It can be seen from the embodiment of FIG. 8 that the shaft upon which the flexible print wheel is mounted may have a lesser number of apices 156 than the number of grooves 154 provided in flexible print wheel 150. Preferably, however, the number of apices 156 should be no less than one-half the number of grooves 154 described in connection with the embodiment of FIG. 8.

Many variations and modifications will now become apparent to those skilled in the art. It is preferred therefore that the present invention be limited not by the specific disclosure herein but only by the appended claims. For example, the print wheel 10 of FIGS. 1*a*–1*c* has 10 raised numerals (0–9) at spaced intervals about the exterior surface. By enlarging the diameters of the print wheel 10 and the pin 16 the print wheel may, for example, accommodate the letters of the alphabet (i.e., A–Z). Alternatively, the print wheel 10 and pin 16 may be made smaller and provide as few as five raised characters spaced about the exterior surface of the print wheel. Also, the print wheel 10 (and/or the index strip 52) instead of having raised characters on the exterior surface, may have a raised surface with the characters being recessed in the raised surface. FIG. 6*e* shows an end view of an index strip 52″ which is of greater thickness than that of strip 52 of FIG. 6*c* and in which the character "C" is recessed in the strip 52″. Thus the print wheels and the index strips would print data in the form of white letters L and index marks M with the ink forming a background band K as shown in FIG. 6*f*.

What is claimed is:

1. An indexable self-aligning printing assembly for mounting upon a holding means comprising:

a mounting pin immovably secured to said holding means and having an annular shaped surface having a polygonal shaped periphery having a cross-sectional configuration comprised of a plurality of spaced, radially outwardly extending projections, the outer free ends of said projections being substantially straight and being parallel to the longitudinal central axis of said pin;

an indexable print wheel being mounted on the pin and being formed of a resilient material and having a closed-loop configuration;

the exterior surface of said print wheel having a plurality of integrally formed raised indicia arranged at spaced intervals along said exterior surface and projecting outwardly therefrom;

the interior surface of said wheel having a configuration of alternating projections and grooves substantially complementary to the configuration of said pin, said wheel being mounted upon and surrounding the periphery of said pin so that the projections of said pin engage selected grooves in said print wheel;

said wheel being adapted to fit upon said pin and experiencing only minimal stretching and deformation when the projections of said pin engage the said selected grooves of said print wheel;

the resilient characteristics of said print wheel permitting said wheel to stretch and permitting the projections of said print wheel to compress when said print wheel is rotated about said pin to enable said print wheel projections to ride over the projections of said pin and to abruptly snap back to their uncompressed or rest state when the projections of said print wheel have passed over the projections of said pin to thereby incrementally index the print wheel about said pin and preventing the print wheel from slipping about said pin when said holding means is moved to urge a portion of the print member against a surface during printing, whereby the aforesaid arrangement eliminates the need for separate additional detent means.

2. The device of claim 1 wherein said pin has a polygon shaped contour comprised of a plurality of flat faces wherein each pair of adjacent flat faces form V-shaped projections.

3. The device of claim 2 wherein the contour of said pin defines a hexagon.

4. The device of claim 2 wherein the contour of said pin defines a pentagon.

5. The device of claim 2 wherein the number of raised characters and projections on said print wheel are equal.

6. The device of claim 5 wherein the number of V-shaped projections on said pin are equal to one-half the number of projections on said print wheel so that the projections on said pin are normally inserted into every other groove in said print wheel when said print wheel projections are in the rest position.

7. An indexable self-aligning printing assembly having a holder means and comprising:

a mounting pin secured to said holder means and having an annular shaped surface having an undulating shaped periphery having a cross-sectional configuration comprised of a plurality of spaced, radially outwardly extending tapered projections which define a V-shaped groove between each two tapered projections, the bases of said grooves and the free ends of said projections being substantially parallel to the longitudinal central axis of said pin;

an indexable print wheel being mounted on the pin and being formed of a resilient material and having a closed loop configuration;

the exterior surface of said wheel having a plurality of integrally formed raised characters arranged at spaced intervals along said exterior surface and projecting outwardly therefrom;

the interior surface of said wheel having a configuration of alternating projections and grooves substantially complementary to the configuration of said pin, said wheel being mounted upon and surrounding the periphery of said pin so that the projections of said pin engage selected grooves of said print wheel;

said wheel being adapted to fit upon said pin and experiencing only minimal stretching and/or deformation when the projections of said pin engage the said selected grooves of said print wheel;

the resilient characteristic of said print wheel permitting said wheel to stretch and permitting the projections of said print wheel to compress when said print wheel is rotated about said pin to enable said print wheel projections to ride over the projections of said pin and to abruptly snap back to their uncompressed or rest state when the projections of said print wheel have passed over the projections of said pin to thereby incrementally index the print wheel through a predetermined angle about said pin and preventing the print wheel from slipping about said pin when said holding means is moved to urge a portion of the front member against a surface during printing, whereby the aforesaid arrangement eliminates the need for separate additional detent means.

8. A rotatable print drum assembly for imprinting variable information upon paper documents as they pass said print drum in a single file fashion, said assembly comprising:

a mounting means for supporting the drum assembly a cylindrical shaped bearing adapted for rotation upon said mounting means;

first and second cylindrical shaped drums secured to and surrounding said bearing;

a plurality of pins having their axes arranged substantially parallel to the longitudinal axis of said bearing and extending from one end of said first drum at spaced intervals adjacent the periphery of said first drum and projecting outwardly from said one end towards an adjacent end of said second drum;

each mounting pin having a generally annular shaped surface having an undulating shaped periphery having a cross-sectional configuration comprised of a plurality of spaced, outwardly extending, radially aligned projections, the free ends of said projections being substantially parallel to the longitudinal central axis of said pin;

said pins being immovably mounted to one of said first and second drums;

a plurality of print wheels each being mounted on one of said pins and each being formed of a resilient material and having a closed-loop configuration;

the exterior surface of each said wheels having a plurality of integrally formed raised characters arranged at spaced intervals along said exterior surface and projecting outwardly therefrom;

the interior surface of said wheel having a configuration of alternating projections and grooves substantially complementary to the configuration of said pin, said wheel being mounted upon and surrounding the periphery of said pin so that the projections of said pin engage selected grooves of said print wheel;

said wheel being adapted to fit upon said pin and experiencing only minimal stretching and/or deformation when the projections of said pin engage the said selected grooves of said print wheel;

the resilient characteristic of said print wheel permitting said wheel to stretch and permitting the projections of said print wheel to compress when said print wheel is rotated about said pin to enable said print wheel projections to compress as they ride over the projections of said pin and to abruptly snap back to their uncompressed state when the projections of said print wheel have passed over the projections of said pin to thereby incrementally index the print wheel through a predetermined angle about said pin and preventing the print wheel from slipping about said pin when the drum rotates during printing whereby the aforesaid arrangement eliminates the need for separate additional detent means;

one end of said second drum being spaced from said first drum and engaging the free ends of said pins whereby the print wheels are sandwiched between said first and second drums;

at least one raised character on each print wheel extending outwardly beyond the periphery of said first and second drums when the print wheels are in the unstretched condition; said pins being adapted to revolve about the axis of rotation of said drum to cause only the characters extending beyond the drum periphery to engage the surface of each paper document as it passes the rotating print drum assembly.

9. The device of claim 8 wherein one of said drums is provided with an annular recess;

a resilient elongated index strip positioned in said recess and having a plurality of integrally formed raised characters extending outwardly from said drum for engaging paper documents as they pass the rotatable assembly the free ends of said index strip being positioned substantially adjacent one another; and means mounted upon said one drum for securing both free ends of said strip in said recess to secure said index strip to said drum assembly.

10. The device of claim 9 wherein said index strip has at least one index mark substantially aligned with the indexed character of one of said print wheels to identify the starting point of the variable information provided by the print wheels.

11. The device of claim 7 wherein the plurality of characters around said print wheel, the number of projections on said print wheel, and the number of projections on said pin are all equal to N where N is a real integer and wherein 5 N 64.

12. The device of claim 11 wherein the preferred range is 5 N 12.

13. The device of claim 11 where N = 10.

14. The device of claim 11 where N = 12.

15. The device of claim 7 wherein each V-shaped projection on said print wheel is truncated to provide a flattened end surface.

16. The device of claim 15 wherein each V-shaped projection on said pin is truncated to provide a flattened end surface.

17. A rotatable print drum assembly for printing variable data upon paper documents as they pass along said assembly in single file fashion, said assembly comprising:

means for supporting the print drum assembly;

a cylindrical bearing rotatably mounted upon said supporting means;

first and second cylindrical shaped drums mounted upon and surrounding said bearing and being secured thereto;

a plurality of pins extending from one end of said first drum in a direction parallel to the longitudinal axis of said bearing and arranged at spaced intervals adjacent the periphery of said first drum;

said pins being immovably mounted to said drum when the drum assembly is in the operative condition and each having a plurality of V-shaped projections arranged at spaced intervals about the periphery of each pin and extending radially outwardly therefrom;

one end of said second drum being adjacent the free ends of said pins;

a plurality of indexable self-aligning print wheels each formed of a resilient material and having a closed-loop configuration, a plurality of integrally formed raised characters extending outwardly from the exterior surface of said wheel at spaced intervals around the wheel;

the interior periphery of said print wheels having a contour of alternating projections and grooves substantially complementary to the contour of said pins;

each wheel being mounted on one of said pins and being positioned between said adjacent spaced ends of said first and second drums;

the resilient characteristic of said wheel enabling said closed-loop to stretch and the projections on said wheel to compress when said wheel is rotated about its pin as the print wheel projections ride upon the pin projections and to snap into an indexed position wherein said wheel projections abruptly return to their uncompressed state and enter said pin grooves to thereby move the print wheel only one character position from one indexed position to the next;

only those characters in said indexed position being adapted to extend beyond the peripheries of said first and second drums to rollingly engage a paper document as it passes the rotating drum assembly whereby the pins are caused to revolve about said mounting means; and the resilient characteristic of said print wheels and the interlocking of the engaging surfaces on said wheels and pins being adapted to prevent the print wheels from being accidentally indexed during the printing operation.

18. A self-aligning printing assembly comprising:

a mounting pin having a generally annular shaped surface having a polygonal shaped periphery having a cross-sectional configuration comprised of a plurality of spaced, outwardly extending, radially aligned projections, the free ends of said projections being substantially parallel to the longitudinal central axis of said pin;

a print wheel indexable about said pin and being formed of a resilient material and having a closed-loop configuration;

the exterior surface of said print wheel having a plurality of integrally formed recesses in the shape of characters arranged at spaced intervals along said exterior surface and extending inwardly therefrom;

the interior surface of said wheel having a configuration of alternating projections and grooves generally conforming to the configuration of said pin, said wheel being mounted upon and surrounding the periphery of said pin so that the projections of said pin engage selected grooves in said print wheel;

said wheel being adapted to fit upon said pin and experiencing only minimal stretching and/or deformation when the projections of said pin engage the said selected grooves of said print wheel;

the resilient characteristic of said print wheel permitting said wheel to stretch and permitting the projections of said print wheel to compress when said print wheel is rotated about said pin to enable said print wheel projections to ride over the projections of said pin and to abruptly snap back to their uncompressed or rest state when the projections of said print wheel have passed over the projections of said pin to thereby accurately incrementally index the chracters on said print wheel through a predetermined angle about said pin and preventing the print wheel from rotating about said pin when printing, whereby the aforesaid arrangement eliminates the need for separate additional detent means.

19. The device of claim 18 wherein the number of recessed characters and projections on said print wheel are equal.

20. The device of claim 18 wherein the exterior surface of the print wheel is provided with recesses adapted to receive the tip of an instrument for indexing said print wheel about said pin.

21. The assembly of claim 1 wherein said holder means includes means for rotatably mounting said holder means;

said pins being mounted on said holder means a spaced distance from the axis of rotation of said holder means enabling at least a portion of said print wheel to rollingly engage a moving surface during printing.

22. The device of claim 8, wherein one of said drums is provided with an annular recess;

a resilient elongated index strip positioned in said recess and having a plurality of integrally formed raised characters extending outwardly from said drum for engaging said paper documents as they pass the rotatable assembly, the elongated sides of said strip being aligned with respective sides of said groove and the short ends of said strip being positioned substantially adjacent one another;

means mounted upon said drum for securing both free ends of said strip in said recess to thereby secure said index strip to said drum assembly.

* * * * *